United States Patent [19]

McNutt

[11] 4,153,891

[45] May 8, 1979

[54] TRANSIENT VOLTAGE DISTRIBUTION IMPROVING LINE SHIELD FOR LAYER WOUND POWER TRANSFORMER

[75] Inventor: William J. McNutt, Pittsfield, Mass.

[73] Assignee: General Electric Company, N.Y.

[21] Appl. No.: 861,460

[22] Filed: Dec. 16, 1977

[51] Int. Cl.[2] ..... H01F 15/04

[52] U.S. Cl. ..... 336/70; 336/84 C

[58] Field of Search ..... 336/84 R, 84 C, 69, 336/70

[56] References Cited

U.S. PATENT DOCUMENTS

| | | | |
|---|---|---|---|
| 2,829,354 | 4/1958 | Sealey | 336/69 |
| 3,106,690 | 10/1963 | Angermeyer | 336/70 |
| 3,353,129 | 11/1967 | Leibinger | 336/84 C X |
| 3,675,175 | 7/1972 | Dutton | 336/84 C X |
| 3,845,436 | 10/1974 | Robin | 336/84 C |

*Primary Examiner*—Thomas J. Kozma

*Attorney, Agent, or Firm*—Francis X. Doyle; Richard A. Menelly

[57] ABSTRACT

An improved electrostatic shield assembly for power transformer windings provides a decreased shield to winding insulation spacing. The decreased spacing substantially improves the capacitive coupling between the windings and shield, reducing transient voltage oscillations within the windings caused by external lighting surges.

6 Claims, 5 Drawing Figures

TRANSIENT VOLTAGE DISTRIBUTION IMPROVING LINE SHIELD FOR LAYER WOUND POWER TRANSFORMER

BACKGROUND OF INVENTION

This invention relates to insulation requirements for power transformer windings wherein troublesome high frequency voltage oscillations can be induced by occurrence of lightning impulses at the transformer terminals. The magnitude of the internal voltage oscillations can be controlled to some extent by the application of various electrostatic shielding techniques. For transformers employing concentric clyindrical windings, the shielding frequently takes the form of an outer enclosing cylinder which is electrically connected to the line terminal of the winding. This cylinder is made up of a plurality of metal foil strips which are heavily insulated from the winding and from surrounding structural parts at ground potential. The electrostatic shield can not consist of a continuous metal enclosure since the presence of strong electromagnetic fields would induce currents in the shield, producing losses and heating.

Since the above described form of electrostatic shield completely encloses the winding, it effectively eliminates most of the dielectric stress to ground from the winding turns and concentrates the stress at the surface of the shield, and, in particular, at the ends of the shield where the spacing to ground is a minimum. To accomodate this stress concentration, the ends of the shield normally are formed with a large radius of curvature and are heavily insulated. To avoid any dielectric weakness, the shield insulation must completely enclose the total shield electrode and is carried continuously over both the inside and outside surfaces of the shield. The presence of thick insulation between the inner surface of the shield and the outer layer of the winding turns reduces the shield to winding capacitance and decreases the effectiveness of the shield in controlling intrawinding voltage oscillations.

The purpose of this invention is to provide an improved shield for power transformers to substantially increase the shield to winding capacitance and reduce the magnitude of transient voltage oscillations with the transformer winding produced by external lightning surges.

SUMMARY OF THE INVENTION

This invention provides a cylindrical electrostatic shield for power transformer windings having substantially reduced shield to winding insulation spacing. Shield to ground insulation requirements are met by heavily insulated auxiliary shield rings placed at each end of the main winding shield.

DESCRIPTION OF THE PREFERRED EMBODIMENT

Figure 1:
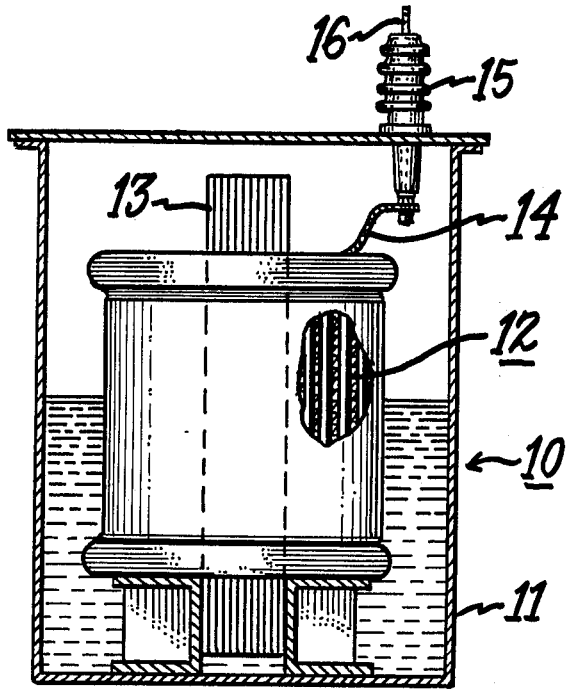
FIG. 1 is a front perspective view of a transformer in partial section for use with the improved electrostatic shield of the invention.

The improved electrostatic shield of this invention is used within transformers of the type depicted in FIG. 1 and consisting basically of the core 13 encompassed by a plurality of windings 12. The transformer 10 also includes at least one lead 14 connecting with an outside contact 16 by means of an insulated bushing 15. In some applications the voltages concerned are in the order of 500,000 volts such that substantial insulation must be provided to ensure that the voltage does not arc between the lead 14 or the windings 12 and the grounded casing 11.

Figure 2:
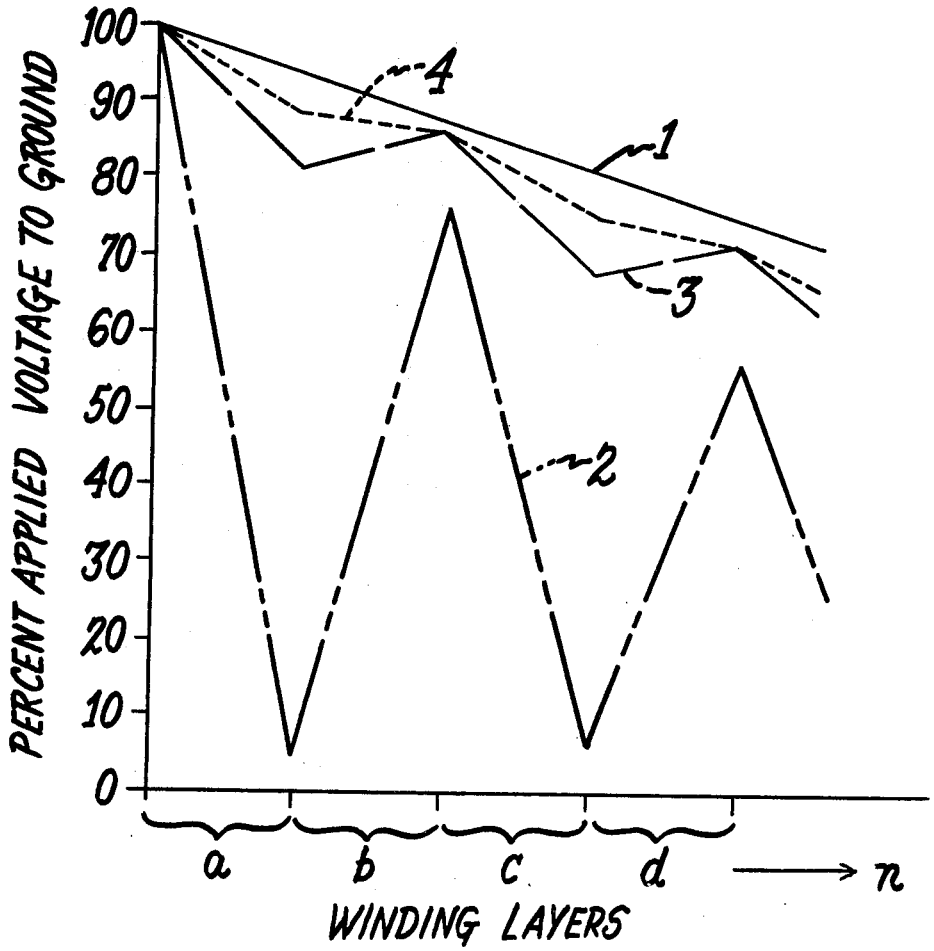
FIG. 2 is a graphic representation of the initial transient voltage distribution within the winding layers for the transformer of FIG. 1 when a very fast front voltage wave is applied at the transformer line terminal.

The purpose of an electrostatic shield can be seen by referring to FIG. 2, which illustrates the fact that transient voltages with very fast wave fronts do not distribute uniformly through a transformer winding. Such fast front transients are produced by lightning strokes. FIG. 2 shows the per cent voltage distribution along the winding layers during a fast front transient voltage condition. FIG. 2 illustrates that the initial response 2 of an unshielded winding is far from the ideal linear distribution 1. Application of the prior art shielding, such as that shown in FIGS. 3 and 4, improves the distribution to the extent shown at 3 in FIG. 2. The degree to which the initial distribution is non-linear determines the magnitude of transient oscillation of the voltage as a function of time, and hence the amount of internal insulation required on the winding turns in layers 12*a* to 12*n* and between the winding layers (12*a* to 12*b*, etc.).

Figure 3:
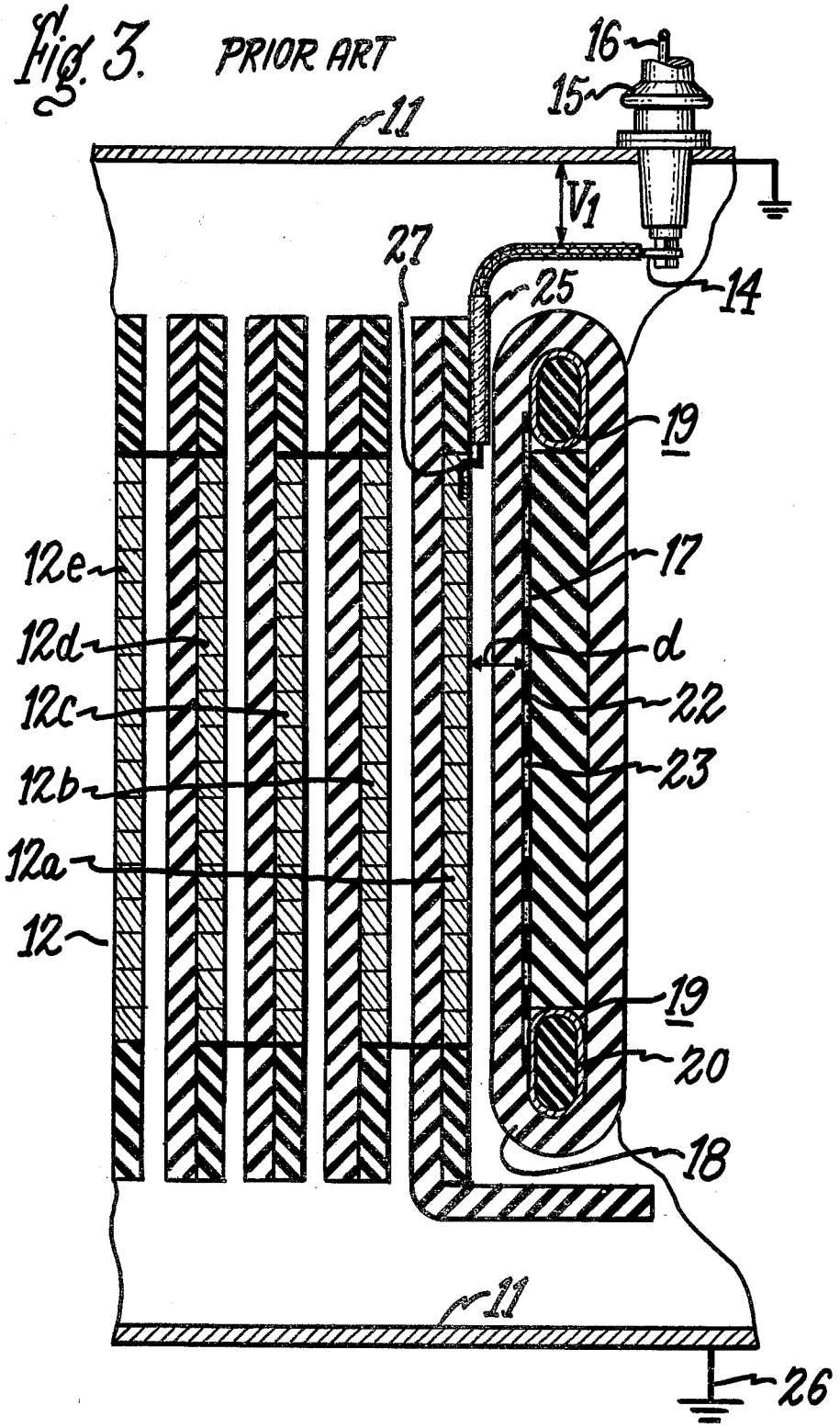
Fig. 3. PRIOR ART
FIG. 3 is a sectional view of one electrostatic shield configuration of the prior art.
Figure 4:
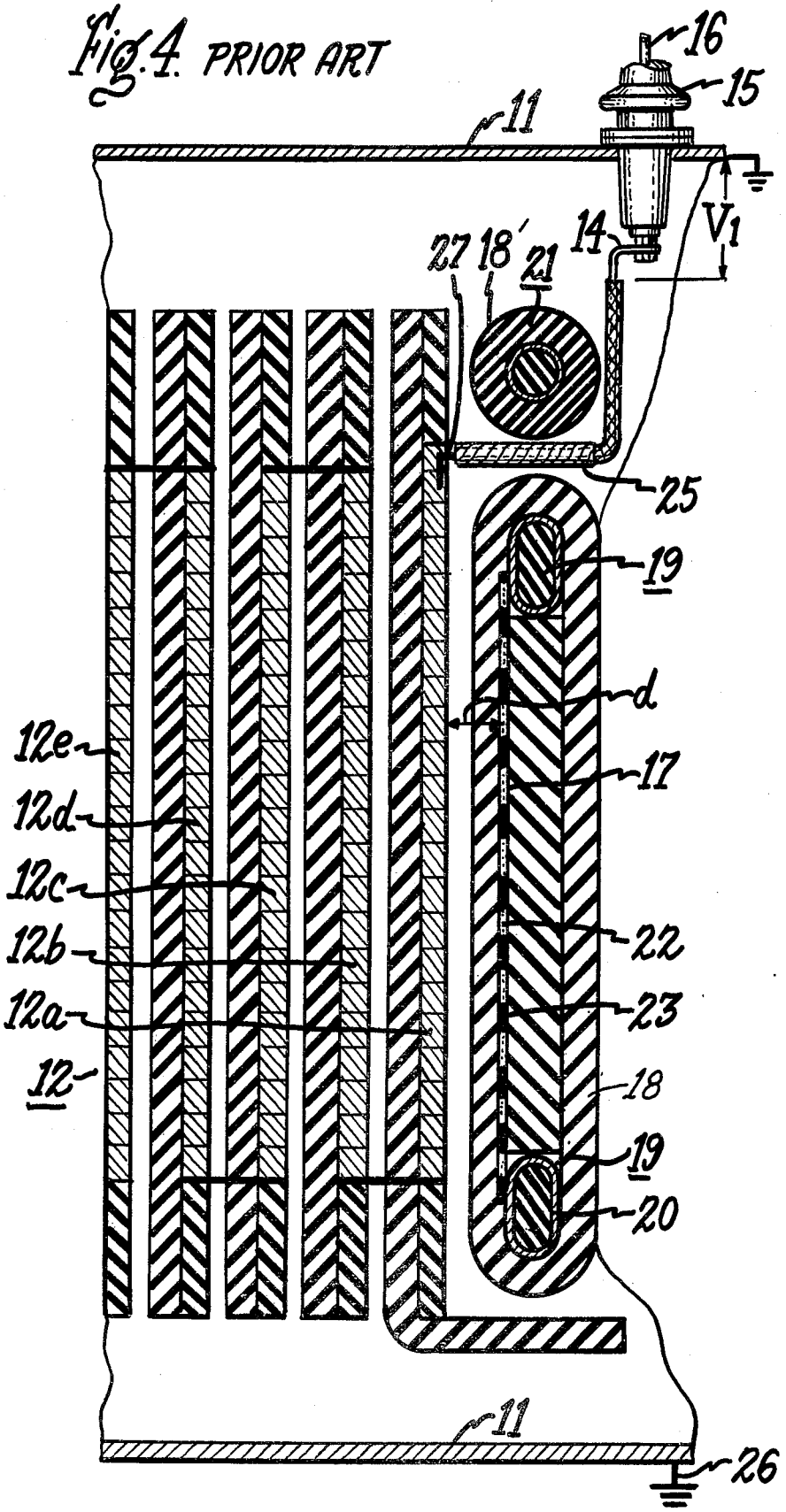
Fig. 4. PRIOR ART
FIG. 4 is a sectional view of another variation of an electrostatic shield configuration of the prior art.

In the prior art shielding arrangements shown in FIGS. 3 and 4, electrostatic shielding is provided by a major shield 17 having alternate conductive regions 22 and insulated regions 23 such as are provided by alternating strips of conductive metal foil on a paper insulated backing. An end shield 19 consisting of a separate conductive shield tubing 20 and enclosed within a common thickness of insulation material 18 is provided at both ends of the major electrostatic shield 17. In one variation of the prior art shown in FIG. 4, which is similar to that disclosed in U.S. Pat. No. 3,353,129, an auxiliary ring shield 21 having a separate insulation 18′ is positioned proximate the end shield 19 with sufficient space provided for passage of the high voltage lead 14. This auxiliary ring 21 serves to protect or shield the high voltage lead 14 from grounded objects proximate to the winding ends. In both variations of the prior art FIG. 3 and FIG. 4, the high voltage lead 14 is electrically connected to one of the windings 12 by means of an electrical weld or braze 27 and is separately insulated by means of a thick winding of insulating tape 25.

The major electrostatic shield 17, the end shield 19, and the auxiliary ring shield 21 are maintained at the same voltage as lead 14. The core 13 and the outer casing 11 are electrically connected to ground.

In the prior art configurations depicted in FIGS. 3 and 4, the thickness of the main shield insulation 18 and the auxiliary ring insulation 18′ is selected to ensure that no dielectric breakdown would occur between the end shield 19 or the auxiliary ring shield 21 and proximate grounded objects, such as the core 13 or the outer casing 11. The thickness of shield insulation 18 and 18′ is typically 1″ for a high voltage transformer. The common practice has been to use a continuous wrapping of the same thickness over the major shield 17 and the end shield 19.

Although the potential existing between the shield assembly, parts 17, 19 and 21, and grounded objects in proximity to it is the full line voltage of the transformer $V_1$, the voltage between the shield assembly 17, 19 and 21, and the winding layer immediately adjacent, 12*a*, is usually only 30% to 50% of the full line voltage $V_1$.

The initial transient voltage distributions previously discussed with reference to FIG. 2, are determined by a capacative network made up of series capacitances between winding layers 12*a*–12*n* and shunt capacitances from said winding layers to ground. The values of these capacitances are established by the spacings between the turns in winding layers 12*a*–12*n*, between winding layers 12*a*–12*n* and from said winding layers to ground, plus the dielectric constant of the insulating materials which occupy these spacings. The shield assembly (17,19,21) provides supplemental series capacitance which has a beneficial effect on the transient voltage distributions as described earlier with reference to FIG. 2. The beneficial effect will be further increased if the supplemental series capacitance which it provides can be increased. The capacitive coupling between the shield 17 and the winding 12 depends primarily upon the separation d (FIGS. 3 and 4) between shield 17 and outer winding 12*a* similar to that existing between parallel plates in a capacitor.

Figure 5:
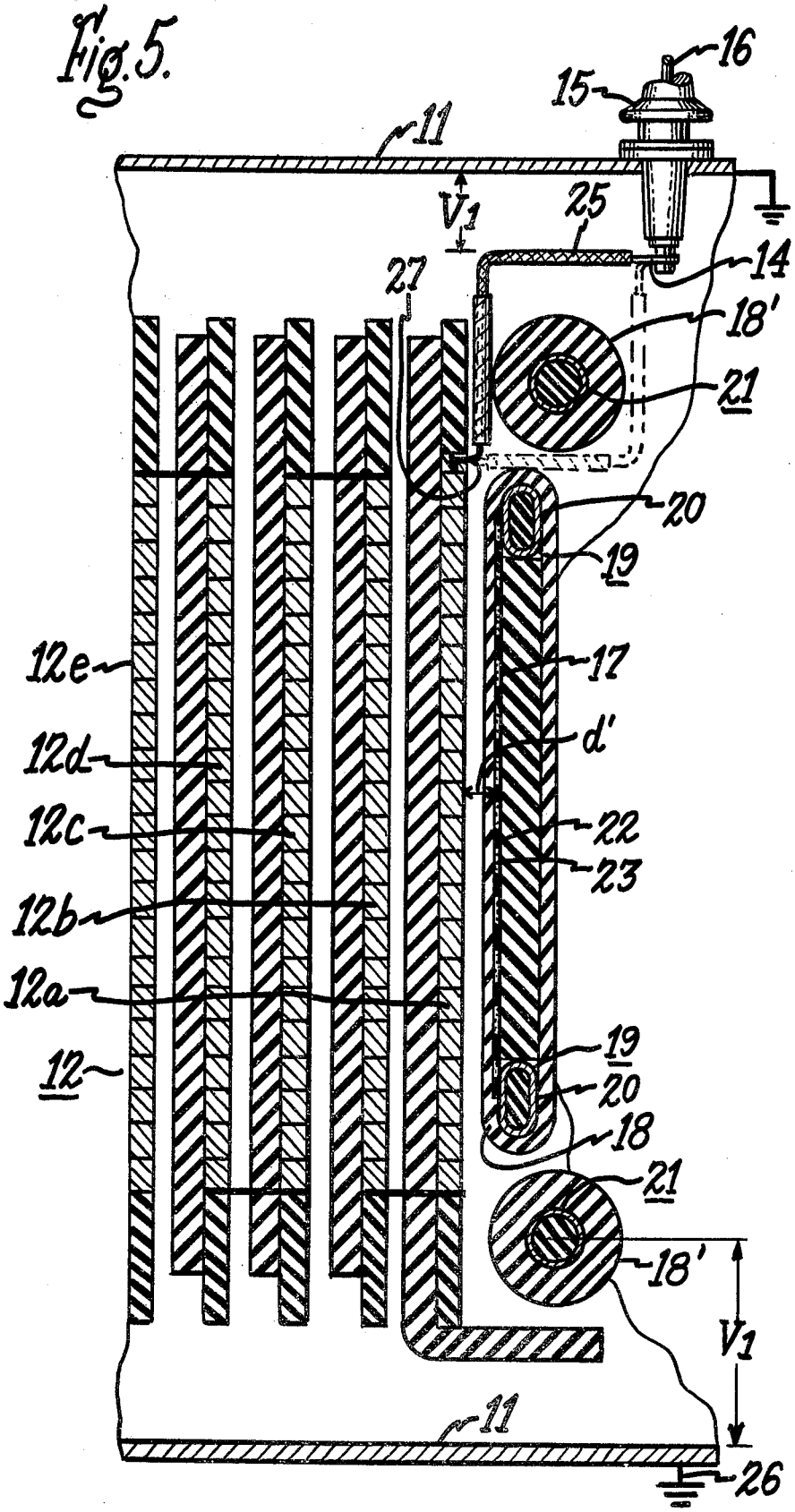
FIG. 5 is a sectional view of the improved electrostatic shield according to the invention.

The improved electrostatic shielding configuration of this invention can be seen by reference to FIG. 5. A plurality of windings 12, consisting of individual winding layers 12*a*–12*e*, are shown relative to the major electrostatic shield 17 and grounded casing 11. An end shield 19 is provided at each end of the major shield 17 and an auxiliary ring shield 21 is provided between each end shield 19 and proximate external grounded parts. The high voltage lead 14 is connected by weld 27 to the first winding member 12*a* at one end and is covered by a plurality of layers of insulation tape 25. High voltage lead 14 is electrically connected to bushing 15 at the other end. External electrical connection is made to the plurality of windings 12 by means of bushing 15 and electrical contact 16. The high voltage lead 14 may alternatively be brought either directly to the bushing 15 or through the space between the adjacent end shield 19 and auxiliary ring shield 21 as shown in FIG. 5.

The improved electrostatic shield configuration of FIG. 5 differs in one respect from that of the prior art shown in FIGS. 3 and 4 in the relative thickness of insulation used for the major shield 17, end shields 19, and auxiliary ring shield 21. All of the insulation and shielding to proximate grounded parts is achieved by means of the heavy insulation 18' on the auxiliary ring shields 21 which remains at approximately 1" thickness. Because the maximum voltage between the shield assembly 17, 19 and 21 and the adjacent winding layer 12*a* is only in the order of 30% to 50% of the full line to ground voltage $V_1$, the insulation 18 over the main shield 17 and the end shields 19 can be greatly reduced to the order of ½" thickness or less.

The substantial reduction in the thickness of the major shield insulation 18 permits reduced spacing d' between the major shield 17 and the adjacent winding layer 12*a* as shown in FIG. 5. The reduced spacing d', in turn, increases the supplemental series capacitance between the shield assembly 17, 19 and 21, and outer winding 12*a*, which serves to further improve the initial transient voltage distribution with the entire winding 12 as shown at 4 in FIG. 2. Reduction of the transient voltage between internal parts of the winding 12, such as between turns in winding layer 12*a*, or between layers 12*a* and 12*b*, etc., permits savings of insulation between these parts in the order of 10% to 40%. The improvement in the percentage of space occupied by conductive winding material such as copper realizes an overall greater design efficiency and provides reduced cost. The reduced insulation between turns in winding layers (12*a*, 12*b*, etc.) and between winding layers 12*a*–12*n* has a cascading effect on the improvement of initial transient voltage distribution. This is due to the reduced spacings between layers and turns, which efficiently increases the series capacitance within the winding. Although the auxiliary ring shield 21 has a round configuration, this is by way of example only. Auxiliary ring shield 21 can have other geometric configurations such as elliptical and rectangular depending upon other design considerations.

Although the improved electrostatic shielding assembly in this invention is described for power transformers, this is for example only. The invention finds application wherever electrostatic shields may be required for transformers of all types and wherein the insulation requirements for the major electrostatic shield can be made substantially less than the insulation requirments for the electrostatic shield to ground for improving the capacitive coupling between the shield and the windings.

I claim:

1. An improved electrostatic shield assembly and transformer windings arranged about an electromagnetic core and including a cylindrical electrostatic shield arranged around the windings having a separation distance from the windings for providing capacitive coupling within the windings, and a pair of electrostatic end shields adjacent both ends of the cylindrical shield, the improvement which comprises:

a pair of auxiliary ring shields adjacent said pair of end shields and having a layer of insulation for providing dielectric breakdown between the auxiliary shields and ground; and a layer of insulation material on the cylindrical electrostatic shield for preventing dielectric breakdown between the cylindrical shield and the windings having a thickness less than the insulation material on the auxiliary electrostatic ring shields for decreasing the separation distance from the cylindrical shield to the windings and increasing the capacitance between the windings and the cylindrical shield.

2. The improved electrostatic shield assembly of claim 1 wherein the insulation on the cylindrical shield is less than 60% of the thickness of the insulation on the auxiliary shield.

3. The improved electrostatic shield assembly of claim 2 wherein the thickness of the insulation on the cylindrical shield is from 30% to 60% of the thickness of the insulation on the auxiliary shield.

4. The improved electrostatic shield assembly of claim 1 wherein the insulation material for the cylindrical shield and the end shields comprise the same material.

5. The improved electrostatic shield assembly of claim 4 wherein the insulation material for the cylindrical shield and the end shields comprise paper.

6. The improved electrostatic shield assembly of claim 5 wherein the insulation material for the cylindrical shield at least partially encloses the end shields.

* * * * *